US008502468B2

(12) United States Patent
Li et al.

(10) Patent No.: US 8,502,468 B2
(45) Date of Patent: Aug. 6, 2013

(54) LIGHT EMITTING BULB, LUMINARY AND ILLUMINATION DEVICE USING LED

(75) Inventors: Po-Wei Li, New Taipei (TW); Yan-Yu Wang, New Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 193 days.

(21) Appl. No.: 13/094,006

(22) Filed: Apr. 26, 2011

(65) Prior Publication Data

US 2012/0056557 A1 Mar. 8, 2012

(30) Foreign Application Priority Data

Sep. 6, 2010 (CN) ..... 2010 1 0272463

(51) Int. Cl.
*H05B 37/02* (2006.01)
*H01J 5/50* (2006.01)
*F21V 21/00* (2006.01)

(52) U.S. Cl.
USPC ..... 315/294; 313/318.01; 362/249.02

(58) Field of Classification Search
USPC ..... 315/294; 362/249.01, 249.02, 249.07; 313/318.01
See application file for complete search history.

(56) References Cited

U.S. PATENT DOCUMENTS

2012/0058663 A1* 3/2012 Oster ..... 439/339
2012/0224377 A1* 9/2012 Altamura et al. ..... 362/249.13

* cited by examiner

*Primary Examiner* — Don Le
(74) *Attorney, Agent, or Firm* — Rabin & Berdo, P.C.

(57) ABSTRACT

A light emitting bulb, a luminary and an illumination device are provided. The light emitting bulb includes a main body and a bulb base. The main body has a plurality of the light emitting units. The bulb base has a plurality of flexible pieces. The flexible pieces are connected to the light emitting units respectively to form a plurality of electrical transmission paths. The luminary further has a lamp holder for holding the light emitting bulb. A control unit in the illumination device is connected to the light emitting bulb through the lamp holder for selectively providing a supply of a power to the light emitting units to control brightness of light emitting units, respectively. The light emitting bulb may facilitate color changing and brightness control without having a control circuit disposed within the light emitting bulb and is associated with a longer lifetime and a lower manufacturing cost.

20 Claims, 9 Drawing Sheets

LIGHT EMITTING BULB, LUMINARY AND ILLUMINATION DEVICE USING LED

BACKGROUND OF THE INVENTION

1. Field of the Invention

The present invention relates to a light emitting bulb, and more particularly, to a light emitting bulb, luminaries and illumination devices which use Light Emitting Diode (LED) as the lighting source.

2. Description of Related Art

LED is a special diode having P-type semiconductor and N-type semiconductor and generating spontaneous emitting of light which belongs to the UV zone, Infrared zone and visible light zone. Since LED has advantages of lower power consumption, long lifespan and high brightness, LED has been widely utilized in lighting devices such as traffic light, street lamp, flashlight, and backlight module of LCD or LED light bulb.

Since some LED bulbs are used to perform functions of color changing, brightness adjusting, electronic components are usually needed for switching power and adjusting brightness. As such, these LED bulb may not properly function mainly due to the lifespan of the most electronic components is shorter than that of LED component. Since the electronic components are usually installed inside the LED bulb and un-replaceable, the whole LED bulb has to be discarded when the electronic components are damaged. That will not only lead to waste of resources, but also make the product lifespan shorten.

SUMMARY OF THE INVENTION

According to aspects of the present invention, a light emitting bulb, a luminary and an illumination device using the LED are provided. The light emitting bulb, the luminary, and the illumination device have a plurality of electrical transmission paths. Through the plurality of electrical transmission paths, the individual LED component inside of the light emitting bulb may be driven and the brightness thereof may be adjusted outside of the light emitting bulb. Therefore, the lighting emitting bulb according to the present invention may function properly even after the lifespan of the electronic component installed therein comes to its end.

In order to have better understanding of the present invention, the following are preferred embodiments and detail description with figures.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompany drawings, wherein like reference numerals refer to like parts throughout the various views unless otherwise specified.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

First Embodiment

Figure 1A:
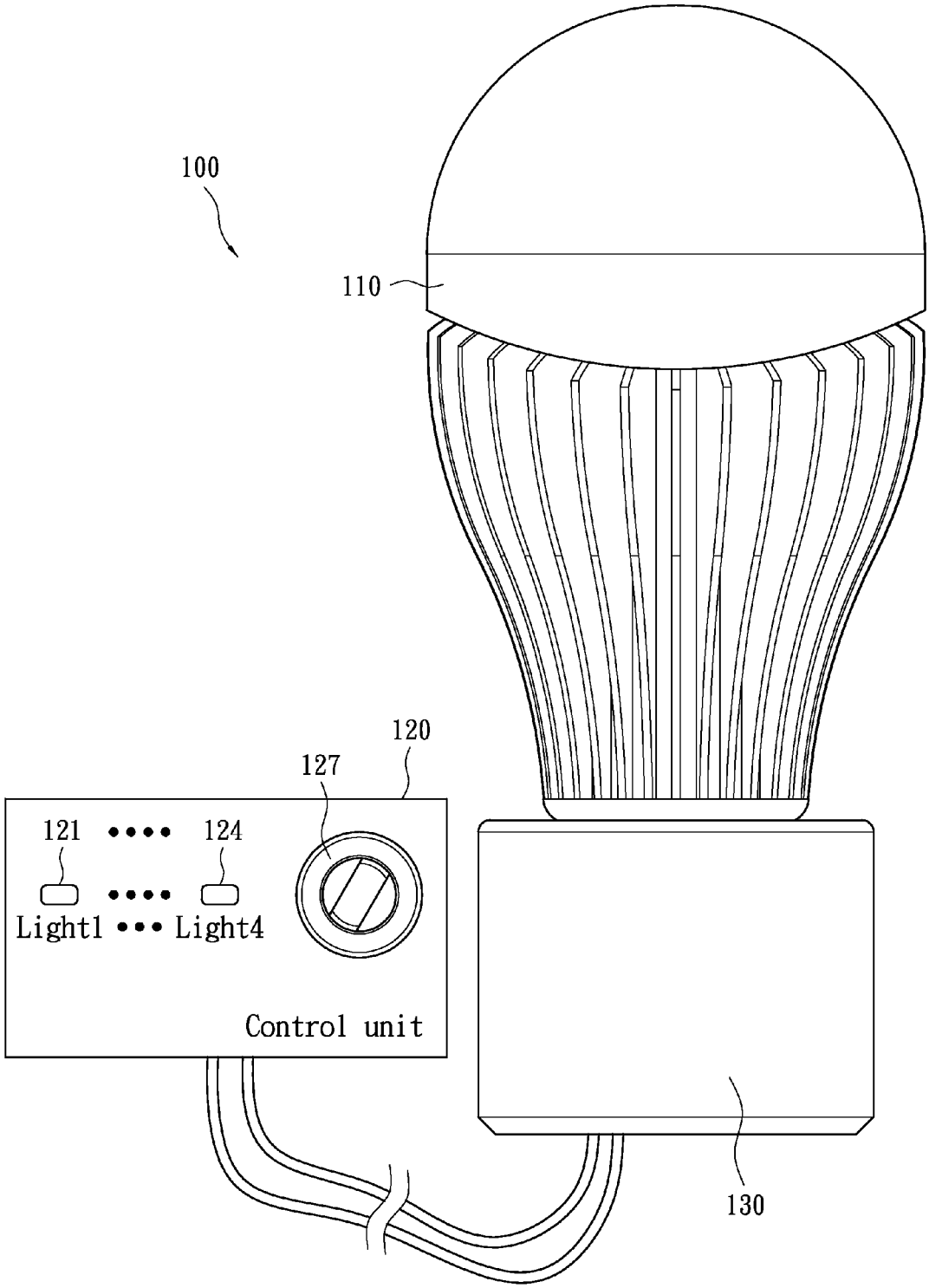
FIG. 1A illustrates a schematic diagram of the illumination device of the first embodiment according to the present invention.

FIG. 1A illustrates a schematic diagram of the illumination device of the first embodiment according to the present invention. The illumination device 100 includes a luminary having a light emitting bulb 110 and a lamp holder 130 and a control unit 120. The light emitting bulb 110 is disposed on the lamp holder 130. And the control unit 120 is electrically connected to the light emitting bulb 110 for controlling power supplied to the light emitting bulb 110 and dimming the brightness of the light emitting bulb 110. The light emitting bulb 110 has a plurality of LEDs grouped into a plurality of light emitting units. For example, a light emitting unit may be a group having two or more LEDs. It is worth noting that the number of LEDs included in the light emitting unit is not limited. Each group of the light emitting units may generate light with different color or color temperature. For example, the light has color tone of cold white, warm white and neutral white. The control unit 120 has buttons 121~124 for switching among different light emitting units and a knob 127 for adjusting lighting intensity of the light emitting units. The number of the buttons may be decided based on the design requirements, and the present invention is not limited thereto. The buttons may correspond to their respective light emitting units and may be configured to control whether the light emitting units function or not. In one implementation, the control unit 120 may be disposed outside of the light emitting bulb 110 such as on the wall of the light emitting bulb 110. The light color and the light brightness of the light emitting bulb 110 may be controlled by the control unit 120.

Figure 1B:
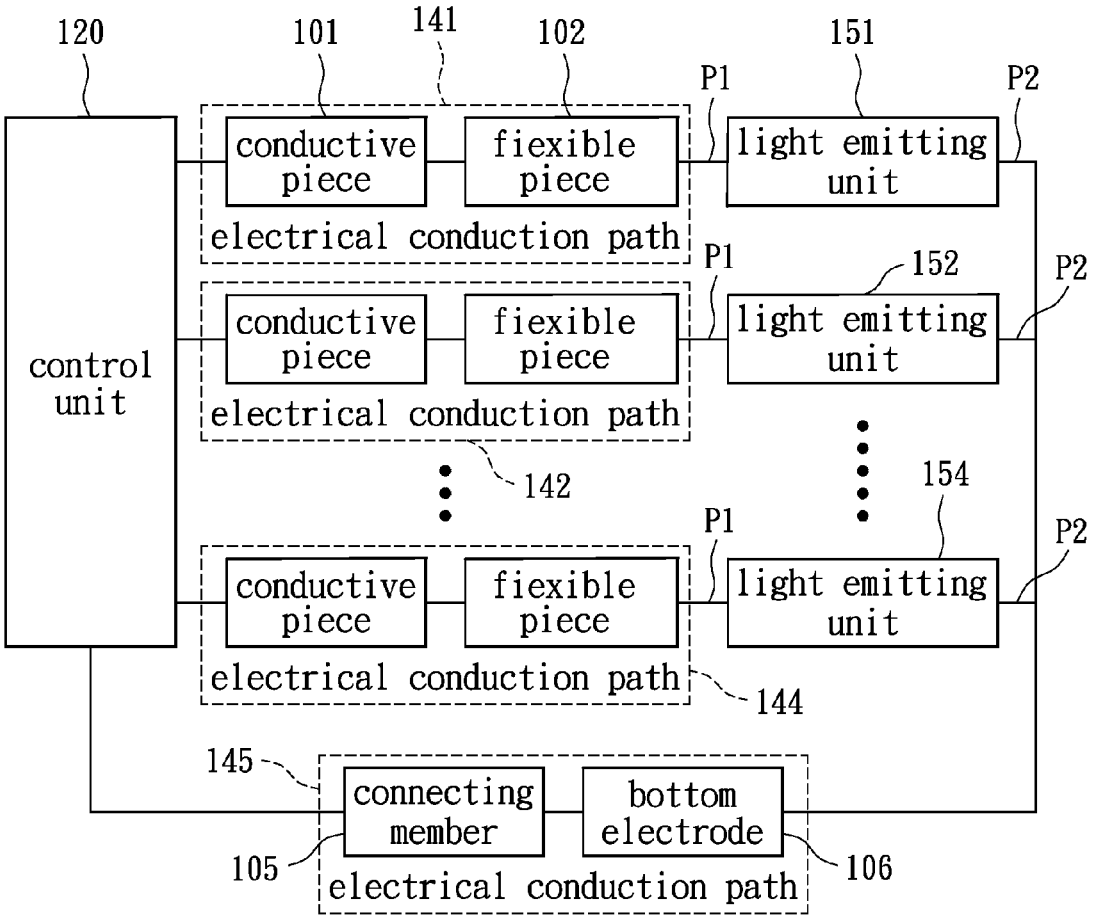
FIG. 1B illustrates the function block diagram of the illumination device of the first embodiment according to the present invention.

In order for the control unit 120 to separately control each light emitting unit, the lamp holder 130 and the light emitting bulb 110 may include a plurality of electrical transmission paths. Each of electrical transmission paths is configured to control its corresponding light emitting unit. Please refer to FIG. 1B which illustrates the function block diagram of the illumination device 100 of the first embodiment according to the present invention. Each of the light emitting units 151~154 has a first end P1 and a second end P2. The first ends P1 of the light emitting units 151~154 are electrically connected to the control unit 120 through the electrical transmission paths 141~144, respectively. The second ends P2 of the light emitting units 151~154 are electrically connected to the control unit 120 only through the electrical transmission path 145.

In the present embodiment, the connection between the electrical transmission paths 141~144 and the light emitting units 151~154 may exist a one-to-one relationship, but the present invention is not limited thereto. In another embodiment, more than one light emitting unit may be connected to one electrical transmission path. Each of the electrical transmission paths 141~144 consists of a conductive piece 101 and a flexible piece 102. The electrical conduction pieces 101 of the light emitting bulb 110 are connected to the flexible pieces 102 of the lamp holder 130 to form the electrical transmission paths 141~144. It is noted that the function of the electrical transmission paths 141~144 is for transmitting signal or electrical current and has no restriction of the number of the conductive pieces 101 and flexible pieces 102. In another embodiment of the present invention, an electrical transmission path may be implemented by connecting conductive pieces 101 to flexible pieces 102, and the present invention is not limited thereto. Those skilled in the art can deduce the other embodiments according to the disclosure of the present invention, and the description is omitted.

Moreover, since the electrical transmission path 145 is connected between the second ends P2 of the light emitting units 151~154 and the control unit 120. The electrical transmission path 145 consisting of a connecting member 105 and a bottom electrode 106 is formed by connecting the connecting member 105 and the bottom electrode 106. The aforementioned conductive pieces 101 and the connecting member 105 are disposed in the lamp holder 130, and the flexible pieces 102 and the bottom electrode 106 are located on the light emitting bulb 110. When the light emitting bulb 110 is disposed on the lamp holder 130, the flexible pieces 102 would be connected to the conductive pieces 101 respectively to form the electrical transmission paths 141~144, and the connecting member 105 would be connected to the bottom electrode 106 to form the electrical transmission path 145.

Figure 1C:
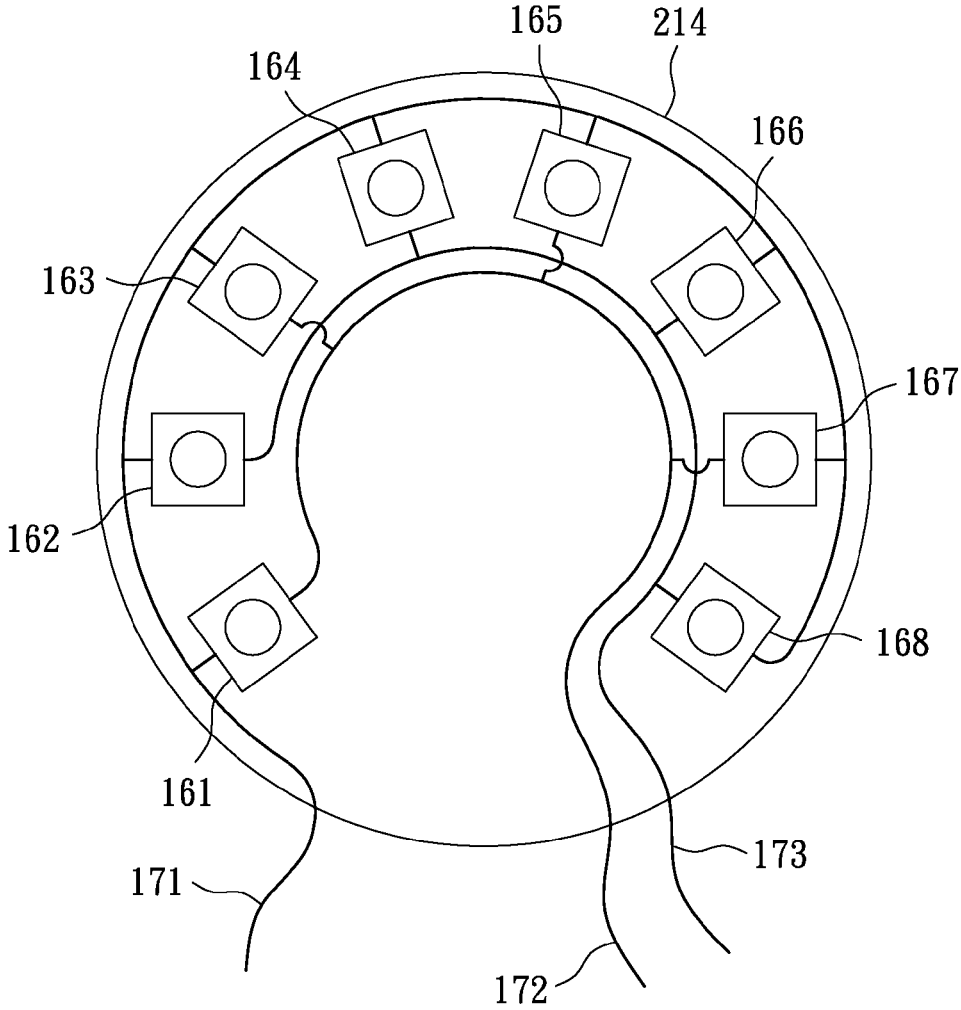
FIG. 1C illustrates the configuration schematic diagram of the LED of the first embodiment according to the present invention.

The light emitting units 151~154 are consisted of LED devices in the light emitting bulb 110. In the present embodiment, each light emitting unit may be formed by several LED devices, but the present invention is not limited thereto. In another embodiment, the light emitting unit may also be formed by a single LED device. For example, the FIG. 1C illustrates the configuration schematic diagram of the LED devices of the first embodiment according to the present invention. The LED devices 161~168 are disposed on the PCB 214 (printed circuit board). The PCB 214 may be a MCPCB (Metal Core Printed Circuit Board) which has superior cooling effect and usually be the substrate of the LED devices. The type of the PCB is not restricted for the instant disclosure.

In FIG. 1C, the LED devices 161~168 are grouped to two sets of light emitting units. One light emitting unit may include the LED devices 161, 163, 165, and 167. Ends of the aforementioned LED devices 161, 163, 165, and 167 (for example, the anodes of the LED devices) are connected to the wire 172. Another light emitting unit may include LED devices 162, 164, 166, and 168. Ends of the aforementioned LED devices 162, 164, 166, and 168 (for example, the anodes of the LED devices) are connected to the wire 173. In addition, ends of the LED devices 161~168 (for example, the cathodes of the LED devices) are connected to the wire 171. The wire 172 and 173 may be considered as the first ends P1 of the light emitting units (such as the light emitting unit 151 and 154 shown in the FIG. 1B), and the wire 172 and 173 may separately be connected to the different electrical transmission path such as 141 and 144, so that the control unit 120 may independently control the two sets of the light emitting units. The wire 171 may be considered as the second ends P2 connecting to the electrical transmission path 145 as shown in the FIG. 1B. The aforementioned two sets of light emitting units may be configured to generate light with different color or different color temperature. Therefore, the light with different color or different color temperature would be generated according to the varying requirements by the control unit 120. Moreover, the method of grouping the LED 161~168 is not restricted by the diagram shown in the FIG. 1C. Different grouping methods and the number of the wires may vary according to the requirements. For example, the LED 161~168 may be grouped into four groups or six groups and are connected to the different wires and electrical transmission paths. Those skilled in the art can deduce the other embodiments according to the disclosure of the present invention, and the description is omitted.

Figure 1D:
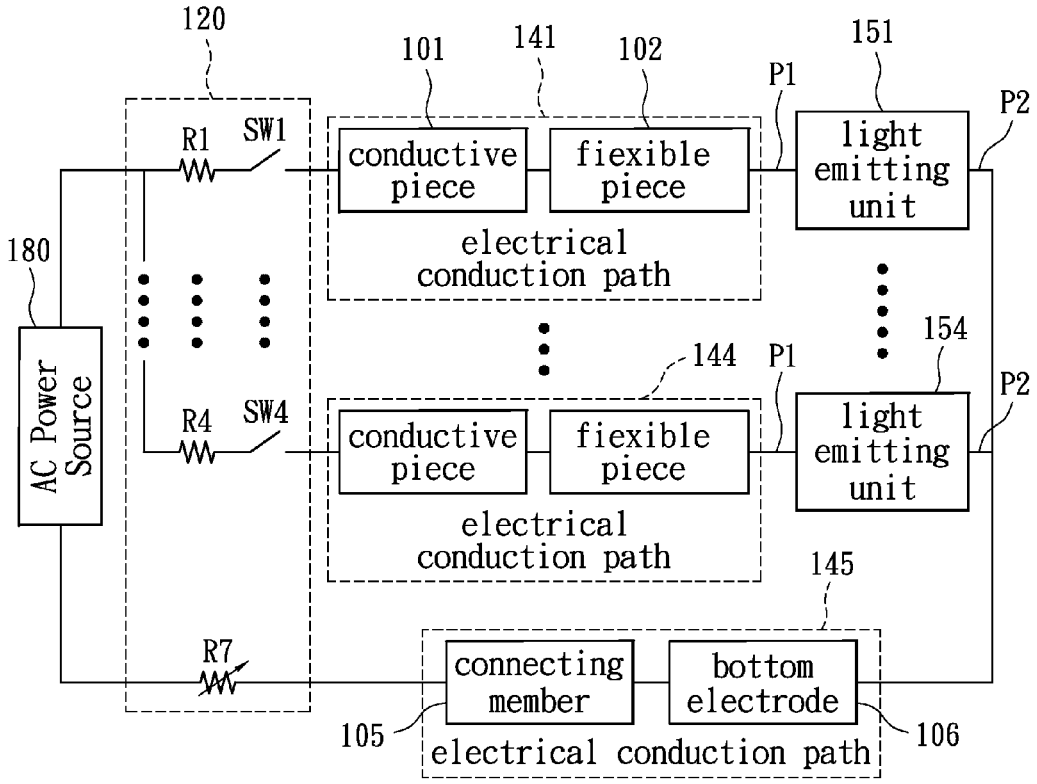
FIG. 1D illustrates the circuit schematic diagram of the illumination device of the first embodiment according to the present invention.

The circuit of the control unit 120 may be implemented in many ways. For example, the FIG. 1D illustrates the circuit schematic diagram of the illumination device of the first embodiment according to the present invention. The control unit 120 has a plurality of switches SW1~SW4 which are respectively coupled between the resistors R1~R4 and the electrical transmission paths 141~144. Ends of the resistors R1~R4 are coupled with an alternating current (AC) power source 180. The switches SW1~SW4 are corresponding to the buttons 121~124 shown in the FIG. 1A, respectively. Thus, the switches SW1~SW4 may be controlled by the buttons 121~124 to determine which light emitting units 151~154 will be turned on. In other words, the buttons 121~124 are corresponding to the electrical transmission paths 141~144, respectively, so that the light emitting units 151~154 may be turned on by the buttons 121~124. The control unit 120 further has a variable resistor R7 coupled between the second ends P2 of the light emitting units 151~154 and the AC power source 180. The resistance of the variable resistor R7 may be controlled by the knob 127 shown in the FIG. 1A to adjust the value of the power current passing through the light emitting units 151~154, thereby adjusting the brightness of the light emitting units 151~154. The buttons 121~124, the electrical transmission paths 141~144 and the light emitting units 151~154 are corresponding to each other and are not restricted for the number of the aforementioned button, the electrical transmission path, and the light emitting unit or the connecting method between them in the present invention. In other embodiments, an electrical transmission path may also comprise a plurality of conductive pieces and a plurality of flexible pieces. Thus, the number of switches does not have to be corresponding to the number of the conductive pieces and the flexible pieces. For example, a switch may be connected to an electrical transmission path having two conductive pieces and two flexible pieces. The electrical transmission path may be electrically connected to only one light emitting unit having a plurality of LED devices. Therefore, if the illumination device has four conductive pieces and four flexible pieces, this would have two electrical transmission paths corresponding to two switches, and two buttons corresponding to different light types such as warm white or cold white may be used to select the desired lighting status. Meanwhile, all light emitting units such as the light emitting unit of warm white plus the light emitting unit of cool white may be turned simultaneously by having all buttons pressed. In addition, in another embodiment, a button may also correspond to multiple sets of the electrical transmission paths. As such, a single button may be capable of controlling the multiple light emitting units.

Moreover, in another embodiment of the present invention, it is worth noting that a multiplexer, not shown in the figure, may replace the switches SW1~SW4 for determining which electrical transmission paths 141~144 to be conducted. Since the control unit 120 is disposed outside of the light emitting bulb 110 and the LED may be AC LED (Alternative Current Light Emitting Diode) or HV LED (High Voltage Light Emitting Diode) requiring no AC/DC convertor for proper operation, the light emitting bulb 110 may continue its operation despite some electrical components of the light emitting bulb 110 malfunction. Since each light emitting unit is powered through different electrical transmission paths, the electrical transmission paths may operate normally despite other electrical transmission paths do not function as originally designed. The switch circuit of the control unit 120 may be implemented in many ways which can be deduced by those skilled in the art according to the disclosure of the present invention, so the details will not be described herein again.

Figure 2:
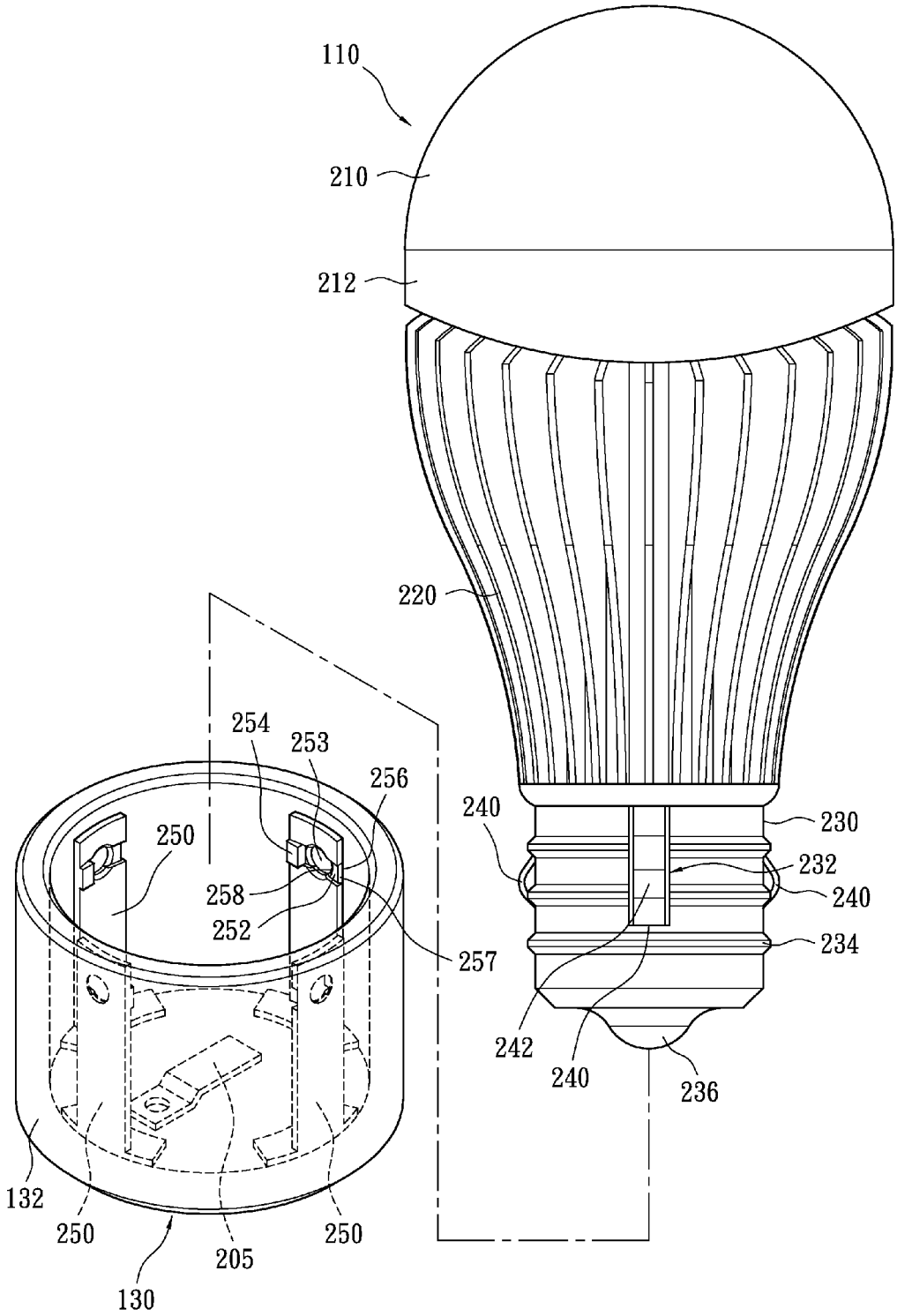
FIG. 2 illustrates the schematic diagram of the luminary with the main structure of the first embodiment according to the present invention.

Then, the followings would further describe the embodiment of the electrical transmission paths 141~144. In the present embodiment, the electrical transmission paths 141~144 are implemented by the luminary structure having the light emitting bulb 110 and the lamp holder 130. The light emitting bulb 110 and the lamp holder 130 are separable. FIG. 2 illustrates the schematic diagram of the luminary with the main structure of the first embodiment according to the present invention. The luminary comprises the light emitting bulb 110 and the lamp holder 130. The light emitting bulb 110 comprises a bulb cover 210, a main body 212 and a bulb base 230. A heat sink 220 is arranged around an external sidewall of the main body 212. The bulb cover 210 is disposed on the main body 212, and the bulb base 230 is connected to a lower end of the main body 212. In the present embodiment, the bulb base 230 is provided with four flexible pieces 240 which protrude outwardly from the bulb base 230 and are distributed around the bulb base 230. An inner sidewall of the lamp holder 130 is also provided with four conductive pieces 250 corresponding to the four flexible pieces 240. An end of each flexible piece 240 is fixed at the inner sidewall of the bulb base 230. Each flexible piece 240 has a flexible portion 242 at a central section of it. The flexible pieces 240 protrude outwardly via the holes 232 on the threaded portion 234 of the bulb base 230. In other words, each flexible portion 242 of the flexible piece 240 protrudes outwardly and passes through the sidewall bulb base 230 via the corresponding hole 232.

Ends of the flexible pieces 240 on the bulb base 230 are electrically connected through the wire to ends of the light emitting unit of the light emitting bulb 110 (such as anodes) respectively. A flexible piece 240 is corresponding to a light emitting unit such as the light emitting unit 151 shown in the FIG. 1B. A threaded portion 234 of the bulb base 230 is made of an insulating material like plastic, and a bottom electrode 236 of the bulb base 230 is made of a conductive material like metal. The threaded portion 234 made of the plastic may prevent the problem of shorted circuit between the neighboring flexible pieces 240. The bottom electrode 236 of the bulb base 230 may be a common electrode connecting to ends of the entire light emitting units such as cathodes. The inner sidewall of the lamp holder 130 is provided with the conductive pieces 250 corresponding to the position of the flexible pieces 240. While the bulb base 230 is disposed on the lamp holder 130, the flexible pieces 240 on the bulb base 230 may contact with the conductive pieces 250 in the lamp holder 130 for transmitting driving current or signals.

The lamp holder 130 comprises a hold body 132, four conductive pieces 250 and the connecting member 205. The conductive pieces 250 may be disposed on the inner sidewall of the hold body 132, and may engage the flexible piece 240 of the light emitting bulb 110. The connecting member 205 is located at the bottom of the hold body 132 for connecting the corresponding bottom electrode 236 of the light emitting bulb 110. In the present embodiment, the structure of each conductive piece 250 is the same. The conductive piece 250 has a positioning groove 252 corresponding to the flexible portion 242 of the flexible piece 240. One end of the positioning groove 252 extends to an edge of the corresponding conductive piece 250 to form an opening 256. The bottom edge of the opening 256 has a chamfer 257 (called a C-shape corner or a right-angled corner) for guiding the flexible portion 242 of the flexible piece 240 on the bulb base 230 into the positioning groove 252 of the conductive piece 250. In the present embodiment, the chamfer 257 is formed by cutting a sloping surface on the bottom edge of opening 256, and the present invention is not limited thereto. The positioning groove 252 further has a positioning hole 253 and the flexible portion 242 press against the positioning hole 253 for positioning the flexible piece 240. The edge of the positioning hole 253 has a fillet 258 called an R-shape corner or a radius corner for enabling a movement of the flexible portion 242 into the positioning hole 253 from the positioning groove 252. Another end of the positioning groove 252 is provided with a protrusion member 254 adjacent to the positioning hole 253. While the bulb base 230 of the light emitting bulb 110 is inserted into the lamp holder 130, with some slight screwing, the flexible pieces 240 of the bulb base 230 may be guided into the positioning groove 252 through the opening 256 and the flexible portions 242 of the flexible pieces 240 would be positioned at the positioning hole 253. And the protrusion member 254 may position the flexible piece 240 at the positioning hole 253 for preventing disconnection between the conductive piece 250 and the flexible piece 240 caused by over-screwing. The number of the flexible pieces 240 and the conductive pieces 250 may increase or decrease based on the design request, and the present invention is not limited thereto. The flexible piece 240 on the bulb base 230 is in contact with the conductive piece 250 in the lamp holder 130 for transmitting driving current or signals. It is worth noting that one of the flexible pieces 240 may be in the electrical connection with one of the light emitting units. In another implementation, more than one flexible piece 240 may be in the electrical connection with one of the light emitting unit, and the present invention is not limited thereto.

When the light emitting bulb 110 is inserted into the lamp holder 130, the flexible pieces 240 on the bulb base 230 are in contact with the conductive pieces 250 in the lamp holder 130 for transmitting power. Please refer to the FIG. 3 in which a sectional diagram of the combination of the lamp holder 130 and the light emitting bulb 110 is illustrated. The light emitting bulb 110 has PCB 214 for the LED devices to be installed thereon and the LED devices are configured as the description of FIG. 1C. The heat sink member 330 is disposed under the PCB 214 and has wire holes 332 inside, so that the wires 320 respectively connecting the flexible pieces 240 and the light emitting units may pass through the heat sink member 330.

In practical application, the bulb base 230 of the light emitting bulb 110 would be inserted into the lamp holder 130 in advance. Thereafter, the flexible portions 242 of the flexible pieces 240 may slide into the positioning groove 252 of the conductive piece 250 with slight screwing of the light emitting bulb before engaging with the positioning groove 252. The flexible portions 242 of the flexible pieces 240 may be engaged with the positioning holes 253 to ensure a secured contact between the flexible pieces 240 and conductive pieces 250 before the current or the signals may be transmitted. This structure is foolproof for avoiding incorrect contact as the result of screwing of the bulb in a wrong direction or over screwing thereof. In addition, the bulb base 230 has a locking member 310 on the inner sidewall for fixing an end of the flexible piece 240. Moreover, it is worth noting that the size of the threaded portion 234 of the bulb base 230 may be the same as the conventional connection portion such as E27 bulb base. Therefore, the light emitting bulb 110 may be directly screwed into the conventional lamp holder such as E27 lamp holder. It is noted that the all light emitting units would be connected to the positive electrode in the lamp holder while the light emitting bulb 110 is directly screwed into the conventional lamp holder. Thus, all of the light emitting units in the light emitting bulb would be turned on or off at the same time.

Figure 3:
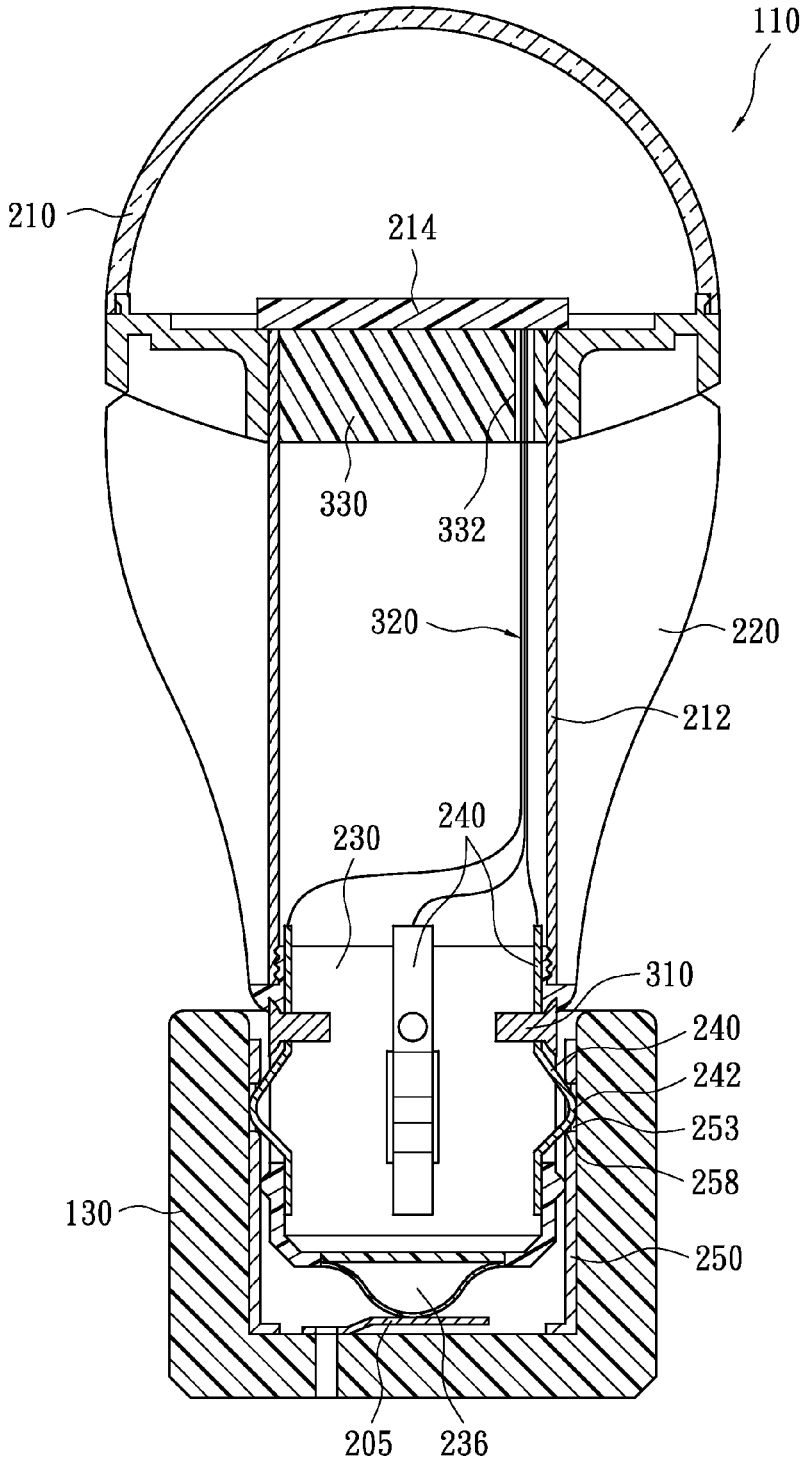
FIG. 3 illustrates a sectional diagram of the combination of the lamp holder and the light emitting bulb.
Figure 4:
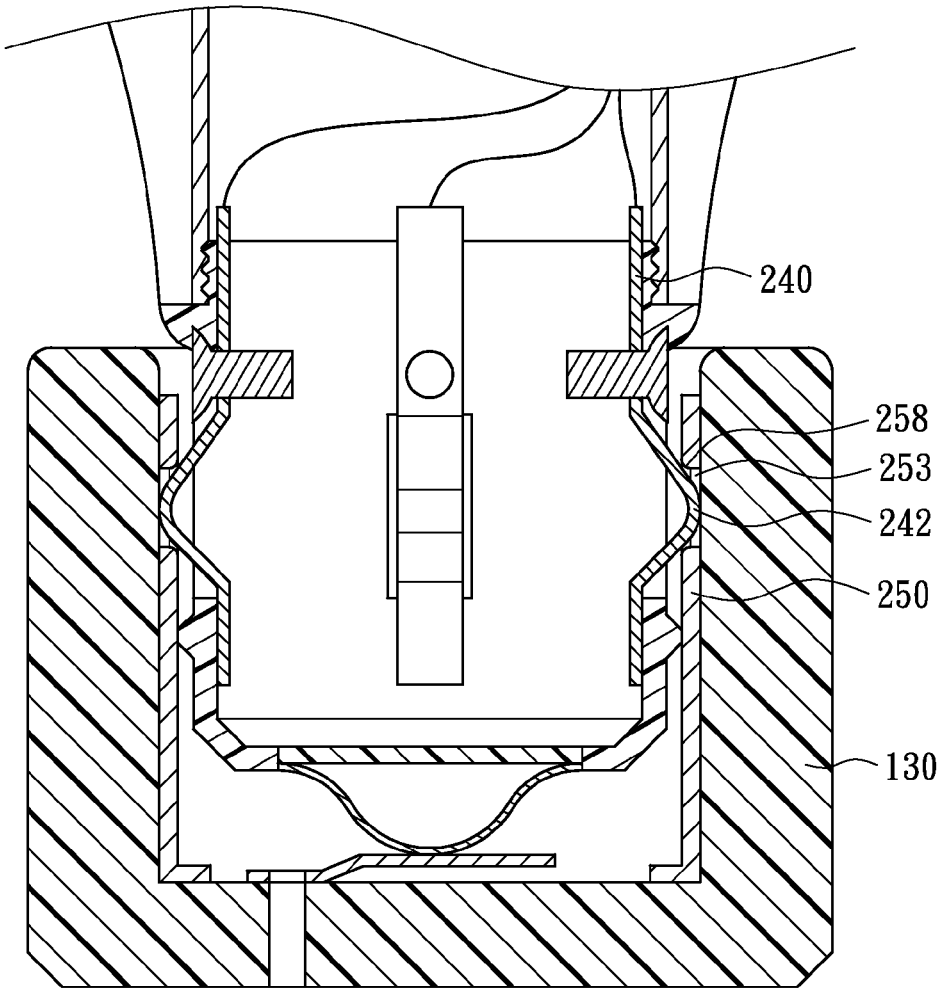
FIG. 4 illustrates the partial sectional diagram according to the FIG. 3.
Figure 5:
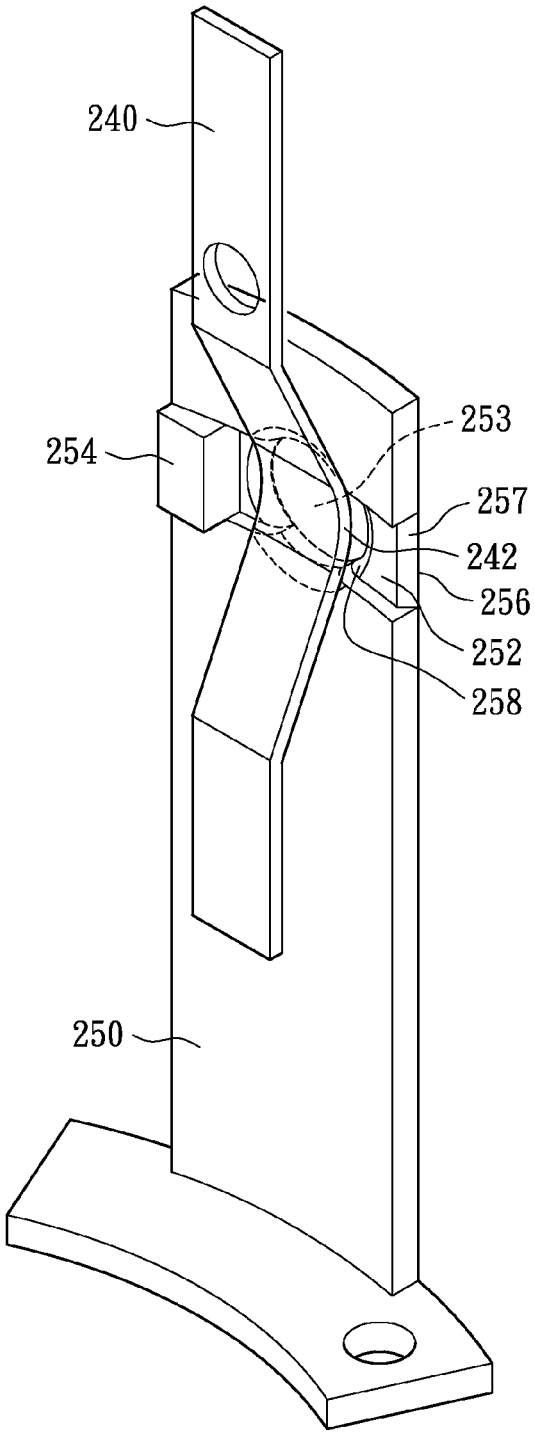
FIG. 5 illustrates the structure schematic diagram of the flexible piece and conductive piece of the first embodiment according to the present invention.

FIG. 4 illustrates the partial sectional diagram according to FIG. 3. The corresponding relation between the conductive piece 250 and the flexible piece 240 may be clearly viewed in FIG. 4. FIG. 5 illustrates the structure schematic diagram of the flexible piece and conductive piece of the first embodiment according to the present invention. When the light emitting bulb 110 is screwed into the lamp holder 130, the flexible piece 240 and the conductive piece 250 would be engaged to each other. The flexible piece 240 may move into the positioning groove 252 of the conductive piece 250 through the opening 256 and is engaged with the positioning hole 253 before the current and the signals may be transmitted. In addition, the edge of the opening 256 has a chamfer 257 for guiding the flexible piece 240 into the chamfer 257. The structures of the rest of the flexible pieces 240 on the light emitting bulb 110 and the conductive pieces 250 are identical to that shown in FIG. 5, and therefore the description is omitted.

Second Embodiment

Figure 6:
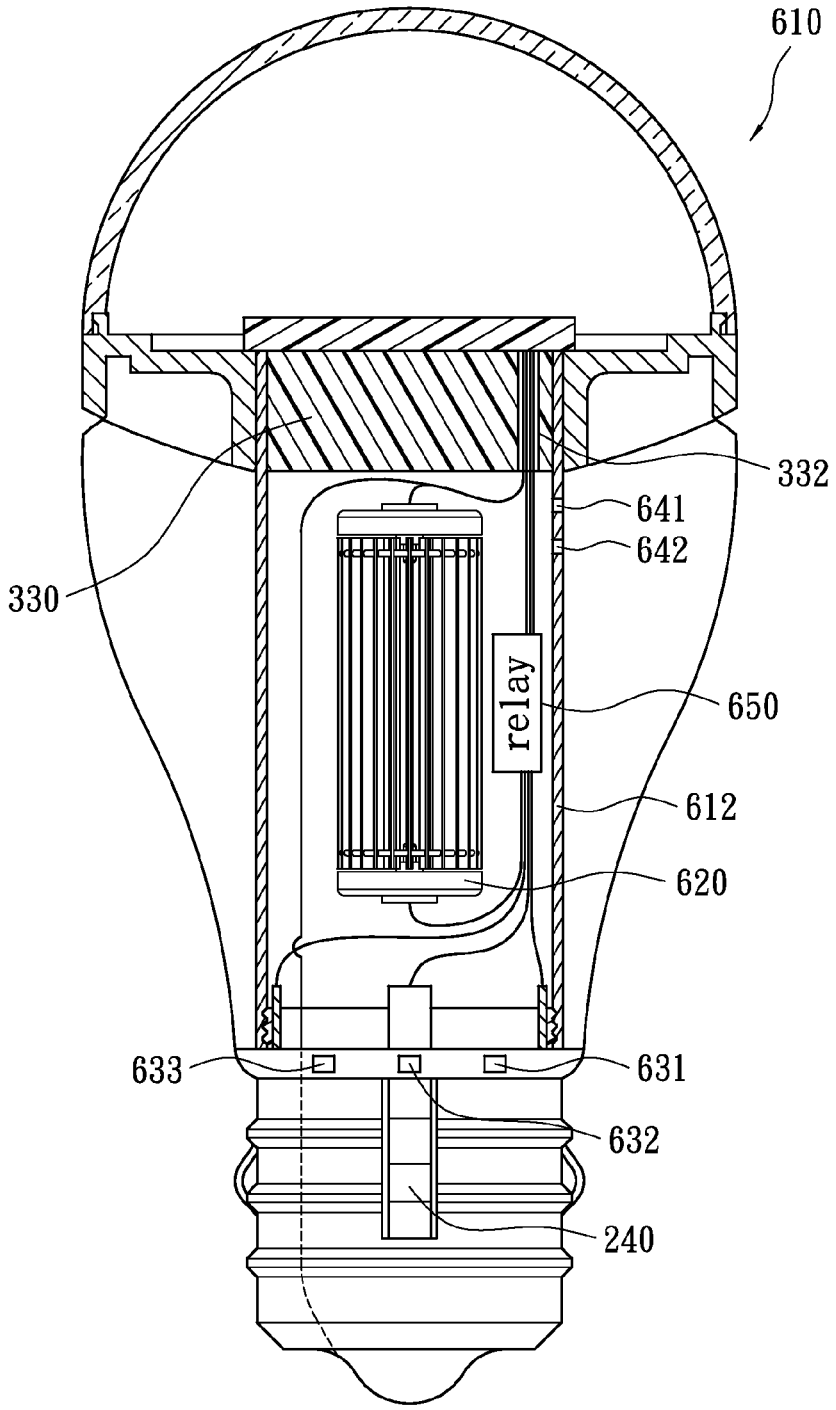
FIG. 6 illustrates the structure schematic diagram of the light emitting bulb of the second embodiment.

In the present invention, since the light emitting bulb requires no driving circuit inside of the light bulb, there would be extra space for the placement of other components. Please refer to FIG. 6 which illustrates the structure schematic diagram of the light emitting bulb of the second embodiment. The interior of a main body 612 of the light emitting bulb 610 is a hollow structure. A centrifugal fan 620 is disposed in the main body 612. The centrifugal fan 620 is disposed in an inner space formed by the heat sink 220 circularly arranged around an external sidewall of the main body 612 and the heat sink member 330. In one implementation, the inner space is roughly U-shaped. The centrifugal fan 620 may suction a cold air from a bottom central of the light emitting bulb 610 and exhaust heat through a top side of the same so as to create a heat cycle to exhaust the heat outside of the light emitting bulb 610. The main body 612 has a plurality of outlets 641 and 642 and a plurality of inlets 631, 632 and 633. The outlets 641 and 642 and the inlets 631, 632, and 633 together serve to communicate the inner space of the light emitting bulb 610 with an exterior outside of the light emitting bulb 610. The outlets 641 and 642 may be located at a top portion of the main body 612 and close to the heat sink member 330 as well as located between the heat sinks 220. The inlets 631, 632, and 633 may be located at a lower portion of the main body 612 and close to the bulb base. Therefore, the cold air may enter into the light emitting bulb 610 through the inlets 631, 632, and 633. The generated heat would be exhausted through the outlets 641 and 642.

Moreover, the light emitting bulb 610 may also have a relay 650. The relay 650 may be connected (in parallel) to wires respectively connected to the flexible pieces 240 from the first ends P1 of the flexible piece 240, as shown in the FIG. 1B, to selectively receive the current, which is transmitted to the conductive pieces 101, as the result of the switched of the control unit 120 shown in the FIG. 1B. The relay 650 may be connected to one end of the centrifugal fan 620 to ensure the centrifugal fan 620 is properly powered. The wire connected to the bottom electrode 106 from the second ends P2 of the light emitting units is connected (in series) to another end of the centrifugal fan 620. For example, two ends of the coil in the relay 650 may be connected to the corresponding light emitting unit in parallel. While the light emitting unit is conducted, the voltage across the two ends of the light emitting unit would generate a certain current passing through the coil to cause electromagnetic effects for attracting an action contact and a stationary contact of the relay 650. Accordingly, the centrifugal fan 620 may receive the current from the electrical transmission paths 141~144 shown in the FIG. 1B associated with the light emitting units that have been switched on. In other words, the relay 650 may selectively provide the supply of the power to the centrifugal fan 620 according to a driving current status of each light emitting unit. Thus, while a light emitting unit is conducted, the relay 650 may provide the supply of the power to the centrifugal fan 620 for cooling the light emitting bulb. It is noted that the present embodiment does not restrict the type of the relay. In other words, an electromagnetic relay, an induction relay, or an electronic relay may be utilized in the present invention as the relay 650. According to the disclosure of the aforementioned embodiment, those skilled in the art can deduce the couplings and applications of different type relays, and the details will not be described herein again. Moreover, in other embodiments, having an extra set of the flexible pieces 240 and conductive pieces 250 for connecting the centrifugal fan 620 or adopting other circuit design for enabling the supply of the power to the centrifugal fan 620 are also within the protective scope of the present invention.

It is noted that the present invention has the LED control circuit installed outside of the light emitting bulb. Therefore, more space inside of the main body 612 may be available for installation of other devices and be not restricted for installed device or components in the present invention.

In summary, the light emitting bulb of the present invention does not require the control or drive circuit inside of the light bulb so that the lifespan of the light emitting bulb is increased and the manufacture cost is reduced. The light emitting bulb has a plurality of individual electrical transmission paths, and thus the objectives of color changing and brightness adjusting may be achieved through controlling different electrical transmission paths by the external control circuit. Besides, the light emitting bulb has the thread part that may be the same as the conventional lamp holder so that the light emitting bulb of the present invention is compatible with the conventional lamp holder.

The light emitting bulb, luminaries and illumination devices provided in the present invention are equipped with the control unit disposed outside of the light emitting bulb. The combination of the external control unit and the structural design of multiple flexible pieces may help solve the issue of the failure of the light emitting bulb to function properly as the result of the malfunction of the electronic components within the light emitting bulb. The light emitting bulb in the present invention may facilitate color changing and brightness control without having the control circuit disposed therein. In comparison with the related art, the light emitting bulb, luminaries and illumination devices in the present invention have advantages of lower power consumption, longer lifespan and lower manufacturing cost.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A light emitting bulb, comprising:

a main body having a plurality of light emitting units disposed therein;

a bulb cover disposed on the main body; and a bulb base connected to the main body and having a plurality of flexible pieces electrically connected to first ends of the light emitting units, respectively and a bottom electrode electrically connected to second ends of the light emitting units.

2. The light emitting bulb of claim 1, wherein the bulb base has a threaded portion having a plurality of holes, each flexible piece has a flexible portion, and the flexible portions of the flexible pieces are disposed corresponding to the holes of the threaded portion.

3. The light emitting bulb of claim 2, wherein the bottom electrode of the bulb base is made of a conductive material and the threaded portion is made of an insulation material.

4. The light emitting bulb of claim 1, wherein the bulb base has a plurality of locking members, and ends of the flexible pieces are fixed to the bulb base via the locking members, respectively.

5. The light emitting bulb of claim 1, further comprising:

a plurality of the heat sinks circularly arranged around an external sidewall of the main body;

a circuit board disposed in the main body and the light emitting units being disposed on one side of the circuit board;

a heat sink member disposed on the other side of the circuit board; and a centrifugal fan disposed in an inner space defined by the heat sinks and the heat sink member;

wherein the main body has a plurality of inlets and a plurality of outlets for communicating the inner space with an exterior outside of the main body, and the inlets are close to the bulb base, and the outlets are close to the heat sink member and locate between the heat sinks.

6. The light emitting bulb of claim 5, wherein one end of the centrifugal fan is electrically connected to the first ends of the light emitting units through a relay, and the first ends of the light emitting units are connected to the relay in parallel, and another end of the centrifugal fan is electrically connected to the second ends of the light emitting units.

7. The light emitting bulb of claim 1, wherein an electrical connection relationship between the flexible pieces and the light emitting units is one-to-one.

8. The light emitting bulb of claim 1, wherein each of the plurality of light emitting units is formed by at least one light emitting diode (LED).

9. A luminary, comprising:

a light emitting bulb, comprising:

a main body having a plurality of light emitting units disposed therein;

a bulb cover disposed on the main body; and a bulb base connected to the main body and having a plurality of flexible pieces electrically connected to first ends of the light emitting units, respectively and a bottom electrode electrically connected to second ends of the light emitting units, each flexible piece having a flexible portion; and a lamp holder for holding the bulb base, comprising:

a hold body; and a plurality of conductive pieces disposed on an inner sidewall of the hold body and corresponding to the flexible pieces;

wherein each conductive piece has a positioning groove corresponding to the flexible portion of the corresponding flexible piece for positioning the flexible pieces respectively.

10. The luminary of claim 9, wherein an end of the positioning groove extends to an edge of the corresponding conductive piece to form an opening, another end of the positioning groove is provided with a protrusion member, a bottom edge of the opening has a chamfer for guiding the flexible portion of the corresponding flexible piece to slide into the positioning groove of the corresponding conductive piece, the positioning groove has a positioning hole through which the flexible portion protrudes outwardly, and a fillet is formed at an edge of the positioning hole.

11. The luminary of claim 9, wherein the bulb base has a threaded portion having a plurality of holes, and each flexible piece has a flexible portion which protrudes outwardly from the bulb base through the corresponding hole.

12. The luminary of claim 9, wherein each of the plurality of light emitting units is formed by at least one LED.

13. An illumination device, comprising:

a light emitting bulb, comprising:

a main body having a plurality of light emitting units;

a bulb cover disposed on the main body; and a bulb base connected to the main body and having a plurality of flexible pieces electrically connected to first ends of the light emitting units and a bottom electrode electrically connected to second ends of the light emitting units; and a control unit electrically connected to the flexible pieces of the bulb base for selectively providing a power to the light emitting units through at least one of the flexible pieces.

14. The illumination device of claim 13, wherein the control unit is electrically connected to the bulb base through a lamp holder, and the lamp holder comprises a hold body, and a plurality of conductive pieces disposed in the hold body for conducting with the flexible pieces.

15. The illumination device of claim 14, wherein each of the conductive pieces has a positioning groove corresponding to a flexible portion of the corresponding flexible piece respectively, and an end of the positioning groove extends to an edge of the corresponding conductive piece to form an opening, another end of the positioning groove is provided with a protrusion member, and a bottom edge of the opening has a chamfer for guiding the flexible portion of the corresponding flexible piece to slide into the positioning groove of the corresponding conductive piece.

16. The illumination device of claim 13, wherein the control unit has a plurality of switches coupled between a power source and the flexible pieces, for selectively providing the power of the power source to the light emitting units through the at least one of the flexible pieces.

17. The illumination device of claim 13, wherein the control unit has a multiplexer coupled between a power source and the flexible pieces for selectively providing the power of the power source to the light emitting units through the at least one of the flexible piece.

18. The illumination device of claim 13, wherein the control unit has a variable resistor coupled between the light emitting units and a power source, and the control unit controls driving currents of the light emitting units by adjusting a resistance of the variable resistor.

19. The illumination device of claim 13, wherein the bulb base has a threaded portion having a plurality of holes, and each flexible piece has a flexible portion which protrudes outwardly from the bulb base through the corresponding hole.

20. The illumination device of claim 13, wherein each of the plurality of light emitting units is formed by at least one LED.

* * * * *